US008382274B2

(12) United States Patent
Mitsuzawa

(10) Patent No.: US 8,382,274 B2
(45) Date of Patent: Feb. 26, 2013

(54) PRINTING SYSTEM, PRINTING CONTROL PROGRAM, AND PRINTING METHOD

(75) Inventor: Toyohiko Mitsuzawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 203 days.

(21) Appl. No.: 12/902,286

(22) Filed: Oct. 12, 2010

(65) Prior Publication Data

US 2011/0128319 A1 Jun. 2, 2011

(30) Foreign Application Priority Data

Nov. 30, 2009 (JP) ..... 2009-272433

(51) Int. Cl.
*B41J 2/01* (2006.01)

(52) U.S. Cl. ..... 347/102

(58) Field of Classification Search ..... 347/102
See application file for complete search history.

(56) References Cited

U.S. PATENT DOCUMENTS

| | | | | |
|---|---|---|---|---|
| 7,131,723 | B2 * | 11/2006 | Hoshino | 347/102 |
| 2006/0066703 | A1 | 3/2006 | Kadomatsu et al. | |
| 2008/0225101 | A1 | 9/2008 | Kumagai | |
| 2009/0174908 | A1 * | 7/2009 | Asai | 358/3.06 |
| 2009/0219342 | A1 * | 9/2009 | Hishida et al. | 347/51 |
| 2009/0322804 | A1 * | 12/2009 | Usuda et al. | 347/6 |
| 2010/0149295 | A1 * | 6/2010 | Kulpa et al. | 347/102 |

FOREIGN PATENT DOCUMENTS

| | | | |
|---|---|---|---|
| JP | 2003-191594 | A | 7/2003 |
| JP | 2005-193527 | A | 7/2005 |
| JP | 2006-102977 | A | 4/2006 |
| JP | 2007-276248 | A | 10/2007 |
| JP | 2008-265285 | A | 11/2008 |
| JP | 2009-056695 | A | 3/2009 |
| JP | 2009-119872 | A | 6/2009 |

OTHER PUBLICATIONS

Machine Englinsh Translation of JP 2003-175725.*

* cited by examiner

*Primary Examiner* — Julian Huffman
*Assistant Examiner* — Sharon A Polk
(74) *Attorney, Agent, or Firm* — Nutter McClennen & Fish LLP; John J. Penny, V.

(57) ABSTRACT

A printing system includes: a head that discharges electromagnetically-curable ink of multiple colors, each color having a different ease of curing with respect to electromagnetic wave, onto a medium; a provisional curing unit, common for all of the colors, that provisionally cures the electromagnetically-curable ink that has landed on the medium by irradiating the electromagnetically-curable ink with electromagnetic waves; and a controller that determines an irradiation condition of the provisional curing unit based on an ink discharge amount for each of the multiple colors per unit of area that has been found based on print data that has undergone a halftone process for each of the multiple colors, the ink discharge amount being weighted based on the ease of curing of each of the colors.

6 Claims, 10 Drawing Sheets

| INK DISCHARGE AMOUNT PER UNIT OF AREA | IRRADIATION ENERGY AMOUNT - FIXED ($10\ mJ/cm^2$) | | IRRADIATION ENERGY AMOUNT - VARIABLE ($10$ TO $20\ mJ/cm^2$) | |
|---|---|---|---|---|
| | BLEED | SURFACE TACKINESS | BLEED | SURFACE TACKINESS |
| $V_{max}$ | GOOD | GOOD | GOOD | GOOD |
| $V_{max}/2$ | NOT SO GOOD | GOOD | GOOD | GOOD |
| $V_{max}/4$ | NOT SO GOOD OR NOT GOOD | NOT SO GOOD | GOOD | GOOD |

FIG. 12

| AMBIENT TEMPERATURE (°C) | EASE OF CURING COEFFICIENT | | | |
|---|---|---|---|---|
| | C | M | Y | K |
| ⋮ | ⋮ | ⋮ | ⋮ | ⋮ |
| 10 | ○○○ | ○○○ | ○○○ | ○○○ |
| ⋮ | ⋮ | ⋮ | ⋮ | ⋮ |
| 25 | ○○○ | ○○○ | ○○○ | ○○○ |
| ⋮ | ⋮ | ⋮ | ⋮ | ⋮ |
| 40 | ○○○ | ○○○ | ○○○ | ○○○ |
| ⋮ | ⋮ | ⋮ | ⋮ | ⋮ |

PRINTING SYSTEM, PRINTING CONTROL PROGRAM, AND PRINTING METHOD

BACKGROUND

1. Technical Field

The present invention relates to printing systems, printing control programs, and printing methods.

2. Related Art

Printing technology including a head that ejects multiple colors of electromagnetically-curable ink onto a medium based on halftone-processed print data and a provisional curing unit that is common for all of the colors and that provisionally cures the electromagnetically-curable ink that has landed on the medium by irradiating the electromagnetically-curable ink with electromagnetic waves has been known for some time.

JP-A-2008-265285 is an example of related art.

However, with this past technology, the ink is irradiated with a constant amount of electromagnetic waves, and thus there is a problem in that the image quality drops depending on the amount and type of electromagnetically-curable ink ejected onto the medium.

SUMMARY

An advantage of some aspects of the invention is to suppress a drop in image quality.

A printing system according to an aspect of the invention includes: a head that discharges electromagnetically-curable ink of multiple colors, each color having a different ease of curing with respect to electromagnetic wave, onto a medium; a provisional curing unit, common for all of the colors, that provisionally cures the electromagnetically-curable ink that has landed on the medium by irradiating the electromagnetically-curable ink with electromagnetic waves; and a controller that determines an irradiation condition of the provisional curing unit based on an ink discharge amount for each of the multiple colors per unit of area that has been found based on print data that has undergone a halftone process for each of the multiple colors, the ink discharge amount being weighted based on the ease of curing of each of the colors.

Other features of the invention will be made clear by the descriptions in this specification and the appended drawings.

BRIEF DESCRIPTION OF THE DRAWINGS

The invention will be described with reference to the accompanying drawings, wherein like numbers reference like elements.

FIG. 12 is a diagram illustrating the data structure of a database indicating correspondence relationships between ambient temperatures and ease of curing of respective colors as stored in the computer in advance.

DESCRIPTION OF EXEMPLARY EMBODIMENTS

Figure 1:
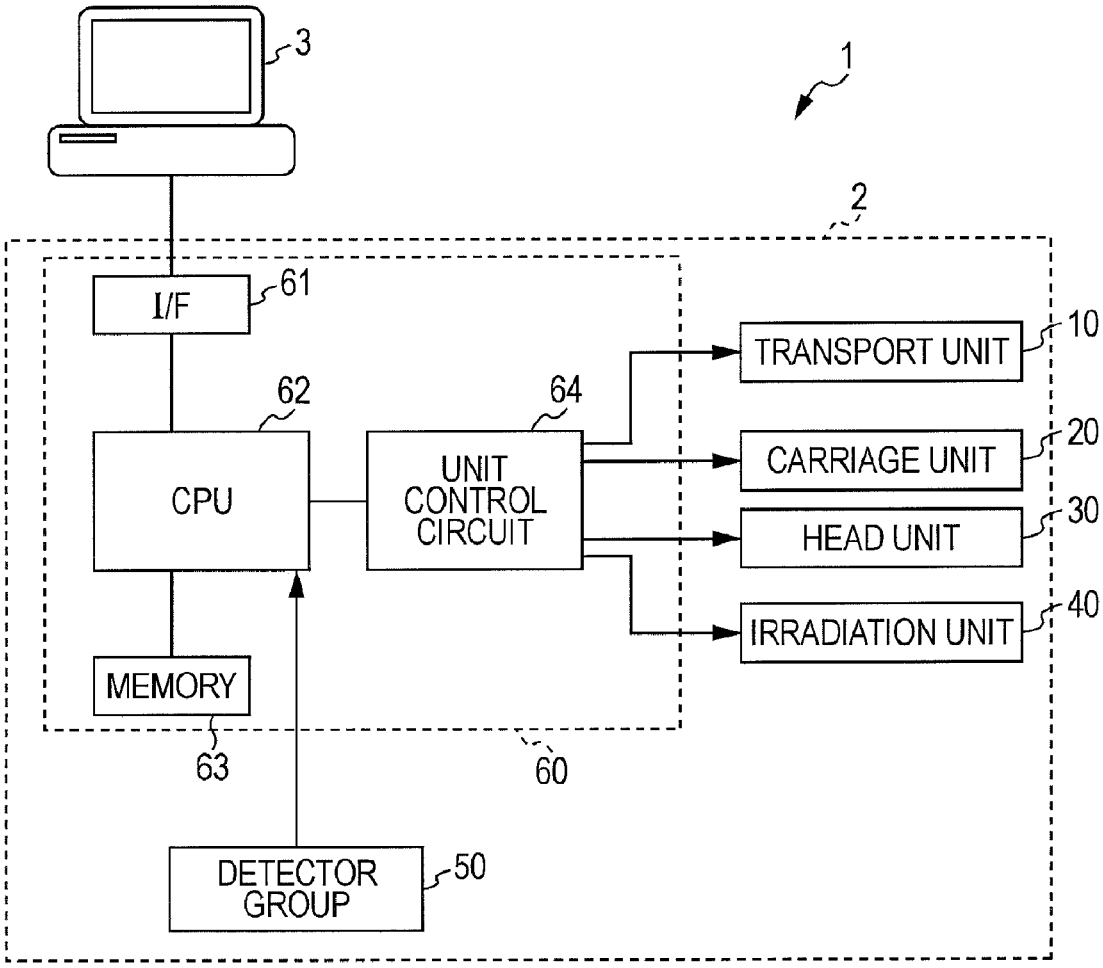
FIG. 1 is a block diagram illustrating the configuration of a printer.

At least the following will be made clear through the descriptions in this specification and the content of the appended drawings.

That is, a printing system according to an aspect of the invention includes: a head that discharges electromagnetically-curable ink of multiple colors, each color having a different ease of curing with respect to electromagnetic wave, onto a medium; a provisional curing unit, common for all of the colors, that provisionally cures the electromagnetically-curable ink that has landed on the medium by irradiating the electromagnetically-curable ink with electromagnetic waves; and a controller that determines an irradiation condition of the provisional curing unit based on an ink discharge amount for each of the multiple colors per unit of area that has been found based on print data that has undergone a halftone process for each of the multiple colors, the ink discharge amount being weighted based on the ease of curing of each of the colors.

According to this printing system, a drop in image quality can be suppressed.

According to the aspect of the invention, the printing system further includes a temperature sensor that detects an ambient temperature; the head discharges, onto the medium, electromagnetically-curable ink of multiple colors whose ease of curing changes depending on the ambient temperature, and the controller finds the ease of curing of each color based on the ambient temperature, and determines the irradiation condition of the provisional curing unit based on the ink discharge amounts for each of the multiple colors per unit of area that have been weighted based on the ease of curing of each color.

According to this printing system, appropriate irradiation conditions can be determined in accordance with the ambient temperature, thus making it possible to further suppress a drop in image quality.

According to the aspect of the invention, the printing system further includes a computer and a printing apparatus capable of communicating with the computer; the computer has the controller and an interface that sends print data that has undergone a halftone process for each of the multiple colors and the irradiation condition of the provisional curing unit to the printing apparatus, and the printing apparatus has the head, the provisional curing unit, and an interface that receives the print data that has undergone a halftone process for each of the multiple colors and the irradiation condition from the computer.

According to this printing system, a drop in image quality can be suppressed.

According to the aspect of the invention, the printing system further includes a computer and a printing apparatus capable of communicating with the computer; the computer has an interface that sends print data that has undergone a halftone process for each of the multiple colors to the printing apparatus, and the printing apparatus has the head, the provisional curing unit, the controller, and an interface that receives the print data that has undergone a halftone process for each of the multiple colors from the computer.

According to this printing system, a drop in image quality can be suppressed.

Meanwhile, a printing control program according to another aspect of the invention is a printing control program for controlling a printing apparatus including a head that discharges electromagnetically-curable ink of multiple colors, each color having a different ease of curing with respect to electromagnetic wave, onto a medium, and a provisional curing unit, common for all of the colors, that provisionally cures the electromagnetically-curable ink that has landed on the medium by irradiating the electromagnetically-curable ink with electromagnetic waves, the program causing a computer to drive: generation of print data that has undergone a halftone process for each of the multiple colors; a function of finding an ink discharge amount for each of the multiple colors per unit of area based on the print data that has undergone the halftone process; and a function of determining an irradiation condition of the provisional curing unit based on the ink discharge amounts for each of the multiple colors per unit of area that have been weighted based on the ease of curing of each color.

According to this printing control program, a drop in image quality can be suppressed.

Meanwhile, a printing method according to another aspect of the invention is a printing method by which a printing apparatus performs printing, the method including: generating print data that has undergone a halftone process for each of multiple colors; finding an ink discharge amount for each of the multiple colors per unit of area based on the print data that has undergone the halftone process; determining an irradiation condition of a provisional curing unit that provisionally cures electromagnetically-curable ink by irradiating the ink with electromagnetic waves based on the ink discharge amounts for each of the multiple colors per unit of area that have been weighted based on an ease of curing of each color; discharging the electromagnetically-curable ink of multiple colors, each color having a different ease of curing with respect to electromagnetic wave, from a head onto a medium; and provisionally curing the electromagnetically-curable ink that has landed on the medium by irradiating the electromagnetically-curable ink with electromagnetic waves from the provisional curing unit based on the irradiation condition.

According to this printing method, a drop in image quality can be suppressed.

First Embodiment

Printer Configuration

A printing system 1 according to this embodiment will be described hereinafter with reference to FIGS. 1, 2, 3A, 3B, and 4. The printing system 1 includes a printer 2 (corresponding to a "printing apparatus") and a computer 3.

Figure 2:
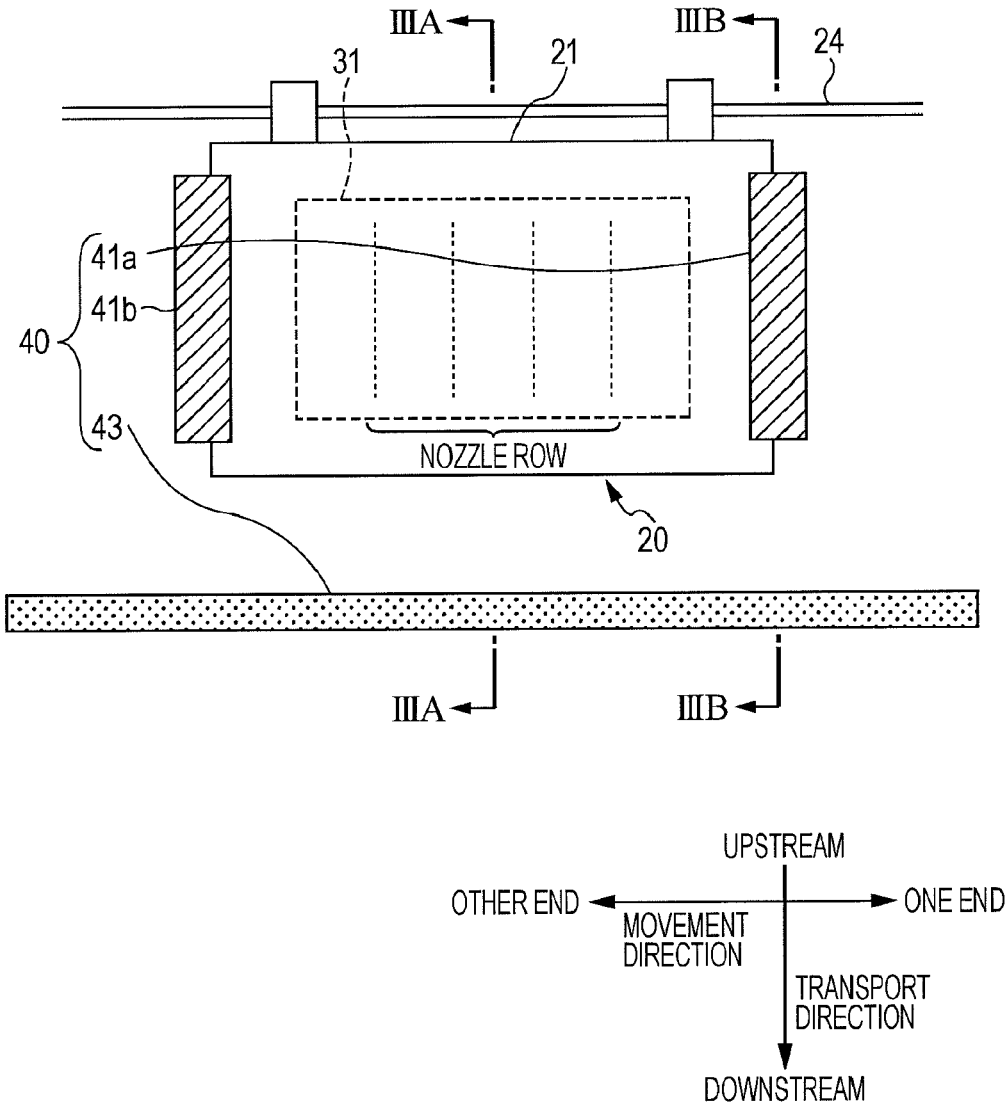
FIG. 2 is a diagram illustrating an overview of the vicinity of a head in the printer.
Figure 3A:
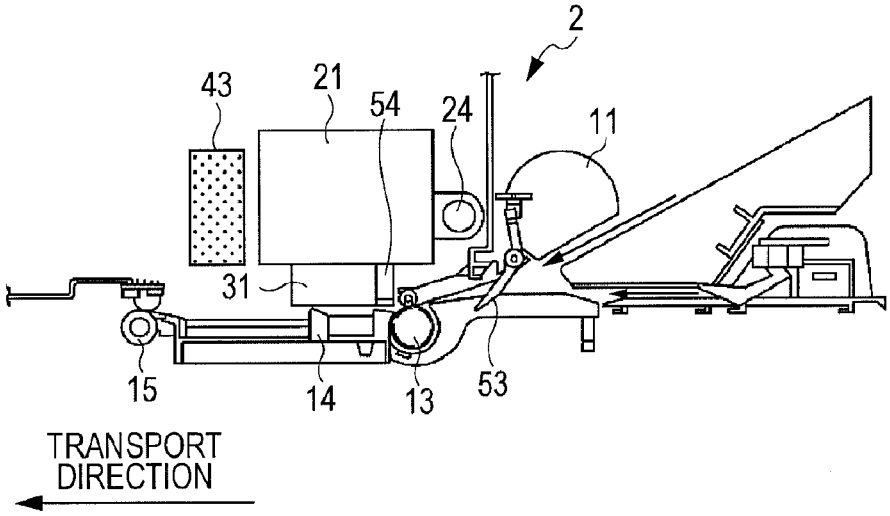
FIGS. 3A and 3B are cross-sectional views of the printer viewed from the side.
Figure 3B:
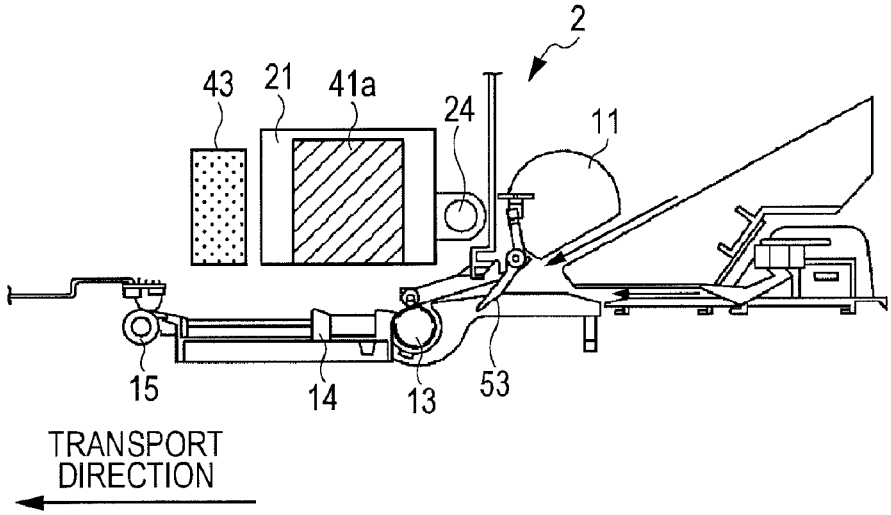

FIG. 1 is a block diagram illustrating the configuration of the printer 2. FIG. 2 is a diagram illustrating an overview of the vicinity of a head in the printer 2. FIGS. 3A and 3B are cross-sectional views of the printer 2 viewed from the side. FIG. 3A is a cross-section viewed along the IIIA-IIIA line shown in FIG. 2, whereas FIG. 3B is a cross-section viewed along the IIIB-IIIB line shown in FIG. 2.

The printer 2 according to this embodiment is an apparatus that prints an image onto a medium such as paper, cloth, a film sheet, or the like by discharging UV curable ink (corresponding to "electromagnetically-curable ink"), which is cured through irradiation with ultraviolet light and is an example of a liquid, onto the medium. The UV curable ink is an ink that includes an ultraviolet light-curable resin, and is cured through a photopolymerization reaction that occurs in the ultraviolet light-curable resin when the resin is irradiated with ultraviolet light. Note that the printer 2 according to this embodiment prints images using UV curable ink of the four CMYK colors, or cyan, magenta, yellow, and black. Meanwhile, the ease of curing when the ink is irradiated with ultraviolet light differs for each of the four inks. Here, the ease of curing of ink with respect to ultraviolet light is defined as the amount of irradiation energy ($mJ/cm^2$) required to cure the ink.

The printer 2 includes a transport unit 10, a carriage unit 20, a head unit 30, an irradiation unit 40, a detector group 50, and a control unit 60. Upon receiving print data from the computer 3, which is an external device, the printer 2 controls the respective units (the transport unit 10, the carriage unit 20, the head unit 30, and the irradiation unit 40) using the control unit 60. The control unit 60 controls the respective units based on the print data received from the computer 3, thus printing an image onto a medium. The internal state of the printer 2 is monitored by the detector group 50, and the detector group 50 outputs detection results to the control unit 60. The control unit 60 controls the respective units based on the detection results outputted by the detector group 50.

The transport unit 10 is a unit for transporting paper S (corresponding to the "medium") in a transport direction. The transport unit 10 includes a paper feed roller 1, a transport motor (not shown), a transport roller 13, a platen 14, and a paper discharge roller 15. The paper feed roller 1 is a roller for feeding paper S that has been inserted into a paper insertion opening into the printer. The transport roller 13 is a roller that transports the paper S supplied by the paper feed roller 1 to a region where printing can be carried out, and is driven by the transport motor. The platen 14 supports the paper S during printing. The paper discharge roller 15 is a roller that discharges the paper S to the exterior of the printer, and is provided downstream, in the transport direction, from the region where printing can be carried out.

The carriage unit 20 is a unit for moving a head 31, described later, in a movement direction, which is perpendicular to the transport direction. The carriage unit 20 includes a carriage 21 and a carriage motor (not shown). The carriage 21 also holds a detachable ink cartridge that contains the UV curable ink. The carriage 21 is supported by a guide shaft 24, described later, that is perpendicular to the transport direction, and moves back and forth in such a state along the guide shaft 24 due to the carriage motor.

The head unit 30 is a unit for discharging UV curable ink onto the paper S. The head unit 30 includes the head 31, which has multiple nozzles. The head 31 is provided in the carriage 21, and thus when the carriage 21 moves in the movement direction, the head 31 also moves in the movement direction. By intermittently discharging UV curable ink onto the paper S while the head 31 moves in the movement direction, a dot line (raster line) is formed upon the paper S in the movement direction.

The printer 2 performs bidirectional printing. Hereinafter, the path of movement from one end to the other end in FIG. 2 will be called an outbound path, and the path of movement from the other end to the one end will be called a return path. In this embodiment, UV curable ink is discharged throughout both the outbound path and the return path.

Figure 4:
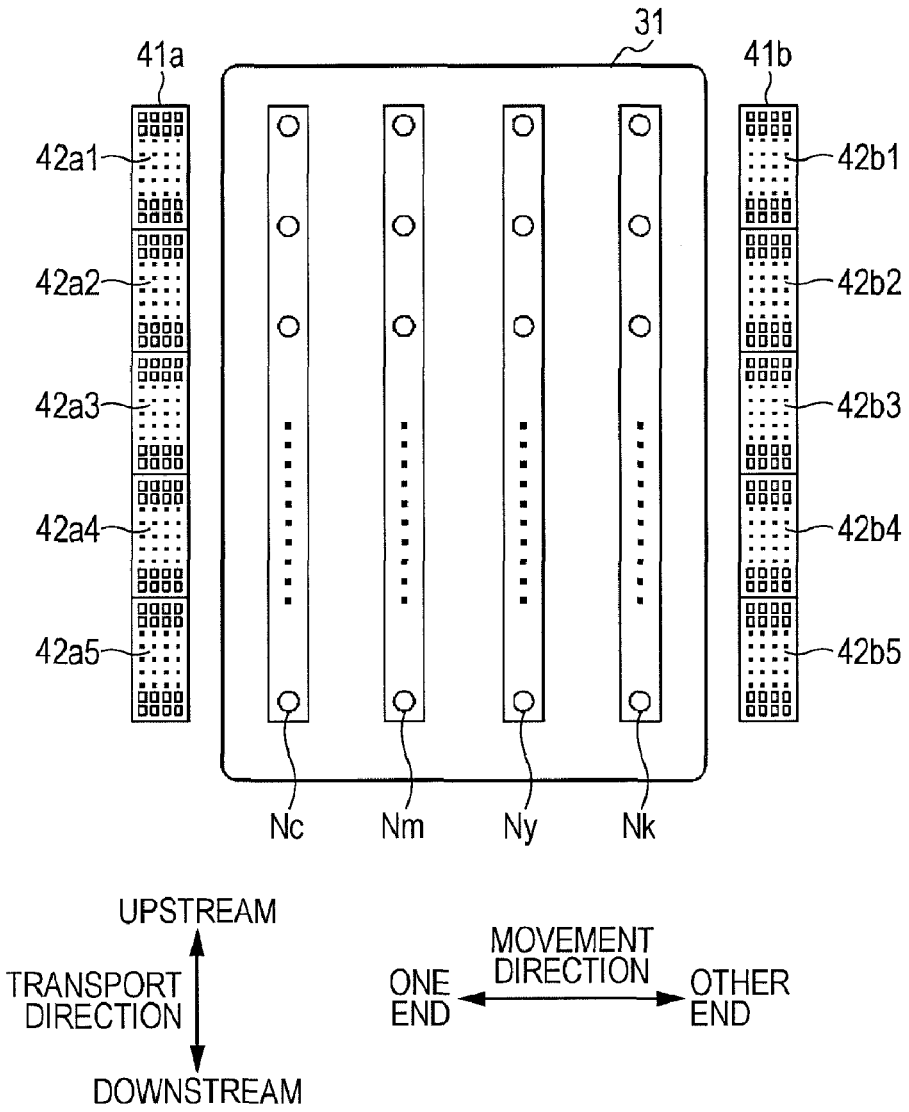
FIG. 4 is a diagram illustrating an example of the configuration of a head.

FIG. 4 is a diagram illustrating an example of the configuration of the head 31. As shown in FIG. 4, a cyan ink nozzle row Nc, a magenta ink nozzle row Nm, a yellow ink nozzle row Ny, and a black ink nozzle row Nk are formed on the bottom surface of the head 31. Each nozzle row includes multiple nozzles, which are discharge openings for discharging UV curable ink of multiple colors.

Piezoelectric elements (not shown), serving as driving elements for causing the UV curable ink to be discharged from the respective nozzles, are provided in the respective nozzles. The UV curable ink is caused to be discharged from the respective nozzles in droplet form by driving the piezoelectric elements using driving signals. The discharged UV curable ink lands on the paper S, forming dots.

The irradiation unit 40 is a unit that irradiates the UV curable ink that has landed on the paper S with ultraviolet light. The dots formed upon the paper S are cured by being irradiated by the ultraviolet light from the irradiation unit 40. The irradiation unit 40 according to this embodiment includes provisional curing units 41*a* and 41*b* and a final curing unit 43. The provisional curing units 41*a* and 41*b* are provided in the carriage 21.

The provisional curing units 41*a* and 41*b* are provided on one side and the other side of the head 31 in the movement direction so as to be opposite on both sides of the head 31. In other words, the provisional curing units 41*a* and 41*b* are provided in locations that are arranged in the movement direction of the head 31. Meanwhile, the lengths of the provisional curing units 41*a* and 41*b* in the transport direction are the same as the lengths of the nozzle rows of the head 31. Furthermore, the provisional curing units 41*a* and 41*b* move along with the head 31, irradiating the dots formed upon the paper S with ultraviolet light and provisionally curing the dots (provisional curing process). In other words, when the head 31 and the provisional curing units 41*a* and 41*b* move from the one end to the other end (move along the outbound path), the provisional curing unit 41*a*, which is located on the forward side of the direction of advancement, irradiates the ultraviolet light, whereas when the head 31 and the provisional curing units 41*a* and 41*b* move from the other end to the one end (move along the return path), the provisional curing unit 41*b*, which is located on the forward side of the direction of advancement, irradiates the ultraviolet light.

The provisional curing units 41*a* and 41*b* respectively include multiple LEDs (Light-Emitting Diodes), each functioning as a light source for ultraviolet light irradiation. The irradiation strength ($mW/cm^2$) of each LED can be changed with ease by controlling the size of the current inputted thereto.

Note that in this embodiment, groups of the multiple LEDs are controlled collectively as irradiation units 42. To be more specific, as shown in FIG. 4, the LEDs in the provisional curing unit 41*a* are grouped into five groups, or irradiation units 42*a*1 to 42*a*5, whereas the LEDs in the provisional curing unit 41*b* are grouped into five groups, or irradiation units 42*b*1 to 42*b*5. The irradiation units 42*a*1 to 42*a*5 and 42*b*1 to 42*b*5 are each capable of being controlled independently, and irradiate respective corresponding irradiation regions.

The final curing unit 43 is provided further downstream in the transport direction than the carriage 21. In other words, the final curing unit 43 is provided further downstream in the transport direction than the head 31 and the provisional curing units 41*a* and 41*b*. In addition, the length of the final curing unit 43 in the movement direction is greater than the width of the paper S, so that the entire surface of the paper S in the movement direction can be irradiated. The final curing unit 43 irradiates ultraviolet light toward the paper S that has been transported to beneath the final curing unit 43 through the transport operations, thus curing the UV curable ink dots that have landed on the paper S. The final curing unit 43 according to this embodiment includes a lamp (a metal halide lamp, a mercury lamp, or the like) as a light source for ultraviolet light irradiation.

The detector group 50 includes a linear encoder (not shown), a rotary encoder (not shown), a paper detection sensor 53, an optical sensor 54, and so on. The linear encoder detects the position of the carriage 21 in the movement direction. The rotary encoder detects the rotation amount of the transport roller 13. The paper detection sensor 53 detects the position of the leading edge of the paper S that is currently being fed. The optical sensor 54 detects the presence/absence of the paper S using a light-emitting portion and a light-receiving portion attached to the carriage 21. The optical sensor 54 can also detect the positions of the ends of the paper S while being moved by the carriage 21, and can thus detect the width of the paper S. In addition, the optical sensor 54 is, depending on the circumstances, capable of detecting the leading edge (the edge on the downstream side in the transport direction; also called the "top end") and the following edge (the edge on the upstream side in the transport direction; also called the "bottom end") of the paper S.

The control unit 60 is a control unit for controlling the printer 2. The control unit 60 includes an interface unit 61, a CPU 62, a memory 63, and a unit control circuit 64. The interface unit 61 serves to exchange data between the computer 3, which is an external device, and the printer 2. The CPU 62 is a computational processing device for carrying out overall control of the printer 2. The memory 63 is a unit for securing a region for holding programs for the CPU 62, a work region, or the like, and has a storage device such as a RAM, an EEPROM, or the like. The CPU 62 controls the respective units via the unit control circuit 64, in accordance with a program held in the memory 63.

When performing printing, the control unit 60 performs passes, which are processes in which dots are formed upon the paper S by discharging UV curable ink of the CMYK colors while moving the head 31 in the movement direction and the dots are cured by irradiating the dots with ultraviolet light while moving the provisional curing units 41*a* and 41*b* in the movement direction. Meanwhile, after each pass, the control unit 60 performs the transport operation, which moves the paper S in the transport direction, which is perpendicular to the movement direction. In other words, the control unit 60 repeats passes and transport operations in an alternating manner.

General Configuration of Computer

Figure 5:
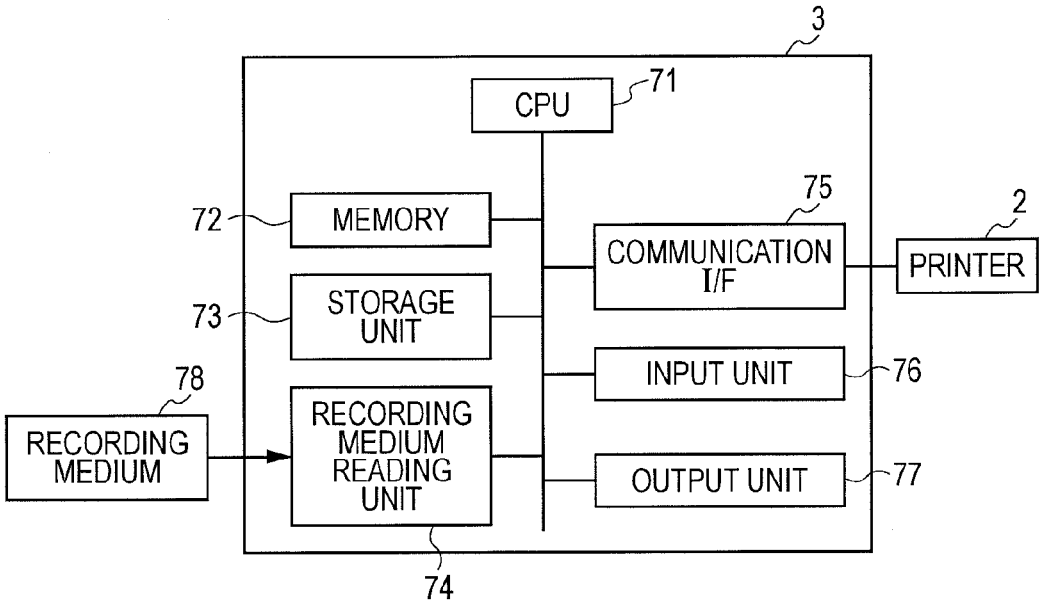
FIG. 5 is a block diagram illustrating functions of a computer communicably connected to the printer.

FIG. 5 is a block diagram illustrating functions of the computer 3, which is communicably connected to the printer 2. As shown in FIG. 5, the computer 3 is configured of a CPU (Central Processing Unit) 71, a memory 72, a storage unit 73, a recording medium reading unit 74, a communication interface 75, an input unit 76, an output unit 77, and so on.

The CPU 71 reads out, to the memory 72, programs such as a printer driver program stored in the storage unit 73, and executes those programs. The memory 72 is, for example, a DRAM (Dynamic Random Access Memory) or the like. The storage unit 73 is, for example, a hard disk drive. The recording medium reading unit 74 is a drive device that reads programs, data, and so on recorded in a recording medium 78 such as a CD-ROM (Compact Disc Read Only Memory), and supplies the read programs, data, and so on to the CPU 71. The communication interface 75 is a network connection unit such as an NIC (Network Interface Card), and connects to the printer 2 and communicates therewith via a connector (not shown). Through this, when the printer 2 receives print data from the computer 3, the printer 2 commences processing for printing based on the print data. Furthermore, the computer 3 receives information regarding the UV curable ink in each cartridge from the printer 2 via the communication interface 75. The input unit 76 is, for example, a keyboard, a mouse, or the like. The output unit 77, meanwhile, is a display or the like.

Figure 6:
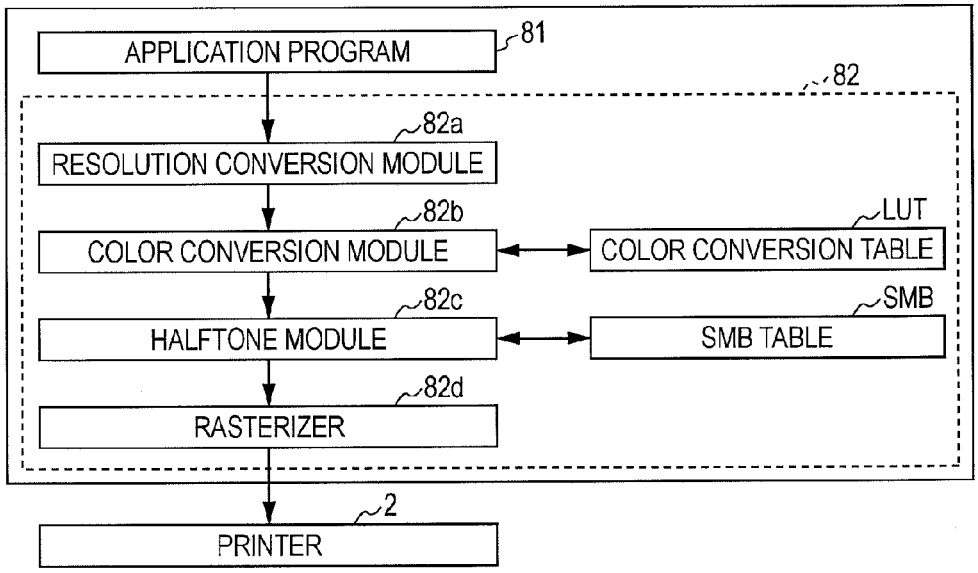
FIG. 6 is a diagram illustrating a program stored in the computer.

FIG. 6 is a diagram illustrating a program that is stored in a controller functionally provided in the computer 3. As shown in FIG. 6, the controller is provided with an application program 81 and a printer driver program 82, and the printer driver program 82 operates with a predetermined operating system (OS). When the printer driver program 82 is loaded into the memory 72 or the like and enters a startup state in which it can be processed by the CPU 71, portions that create the print data are functionally implemented.

The application program 81 referred to here is, for example, a program for image processing or image display; the application program 81 processes an image loaded from a digital camera or the like, an image rendered by an operator, and so on, and is executed when a predetermined image is outputted to the printer driver program 82 after first being displayed.

In addition, the printer driver program 82 receives image data from the application program 81 based on a print command from the application program 81, and converts that data into print data to be supplied to the printer 2. The printer driver program 82 includes a resolution conversion module 82*a*, a color conversion module 82*b*, a halftone module 82*c*, a rasterizer 82*d*, a color conversion lookup table, and an SMB table.

The resolution conversion module 82*a* is a module that converts the resolution of color image data formed by the application program 81 into a resolution to be used during printing by the printer 2 (for example, in the case where the printer 2 prints at 720 dpi×720 dpi, the resolution of the image data is converted to 720 dpi×720 dpi). The color conversion module 82*b* converts, on a pixel-by-pixel basis, RGB image data into multitone data of multiple ink colors that can be used by the printer 2, with reference to the color conversion lookup table. For example, in the case where the printer 2 employs four colors, or CMYK, the multitone data that has undergone color conversion is CMYK data expressed as, for example, 256 tones in the CMYK system.

The halftone module 82*c* is a module that performs a process for converting the aforementioned multitone data (CMYK data) into print data of the number of tones formed by the printer 2. For example, in the case where the head 31 is capable of discharging large, medium, and small ink droplets, the halftone module 82*c* performs, with reference to the SMB table, a process for converting the multitone data into data with a large/medium/small/none specification for individual pixels. Correspondence relationships indicating how many of the respective large/medium/small dots are to be generated for the multilevel tone values of each color indicated by each piece of pixel data are stored in advance in the SMB table.

Note that in the halftone process, the image data is formed by distributing individual pixels (dots) through a method such as dithering, error diffusion, or the like.

The rasterizer 82*d* is a module that performs a process for rearranging the post-halftone process print data into a data order for transfer to the printer 2. The post-rasterizing print data is sent to the printer 2 along with data indicating a sending amount.

Printing Process Flow

Figure 7:
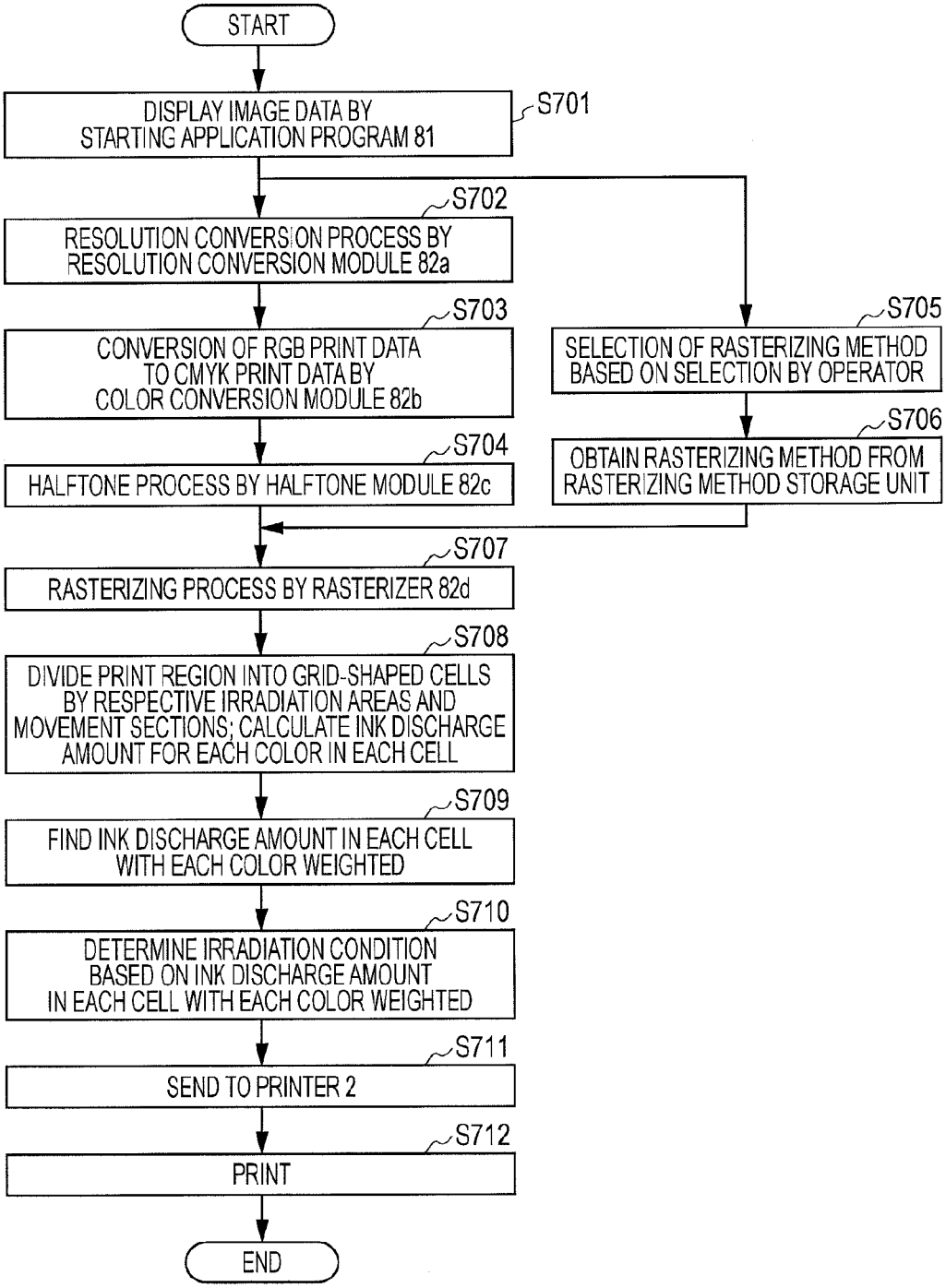
FIG. 7 is a flowchart illustrating a printing process in the case where printing is performed by a printing system.

FIG. 7 is a flowchart illustrating a printing process executed by the controller in the case where printing is performed by the printing system 1. The printing process will be described hereinafter with reference to FIG. 7.

First, prior to the print, an operator launches the application program 81 and displays desired image data (S701).

When the operator selects a predetermined print mode, such as a mode for performing high-definition printing, and then instructs the print to be commenced, the printer driver program 82 is launched based on that print instruction. When the printer driver program 82 is launched, first, the resolution conversion module 82*a* executes a resolution conversion process on the image data for printing by the printer 2 (S702).

The print data that has undergone the resolution conversion process then undergoes color conversion by the color conversion module 82*b* from RGB print data into CMYK print data, or in other words, into multitone data of the respective colors, or cyan print data, magenta print data, yellow print data, and black print data (S703).

The print data that has undergone the color conversion process then undergoes the halftone process performed by the halftone module 82*c* (S704). In other words, the multilevel tone values indicated by each piece of pixel data of which the CMYK print data is configured are converted, with reference to the SMB table, into dot tone values of few levels (for example, large, medium, small, and none) capable of being expressed by the printer 2.

The computer 3 receives inputs from the operator regarding the image quality level, such as photograph quality (high quality), text quality (normal quality), and so on. The computer 3 selects the printing method, selecting FOL (Full Over Lap) printing in the case where photograph quality has been selected, POL (Part-Line Over Lap) printing in the case where normal quality has been selected, and so on (S705). Then, the computer 3 obtains a rasterizing method corresponding to the selected printing method from a rasterizing method storage unit that stores various types of rasterizing methods (S706).

The print data that has undergone the halftone process then undergoes the process for rearrangement into a data order for transfer to the printer 2 (the rasterizing process) performed by the rasterizer 82*d* (S707). In other words, the print data is rearranged into an order for formation as dots upon the paper S by discharging UV curable ink from the head.

Figure 8:
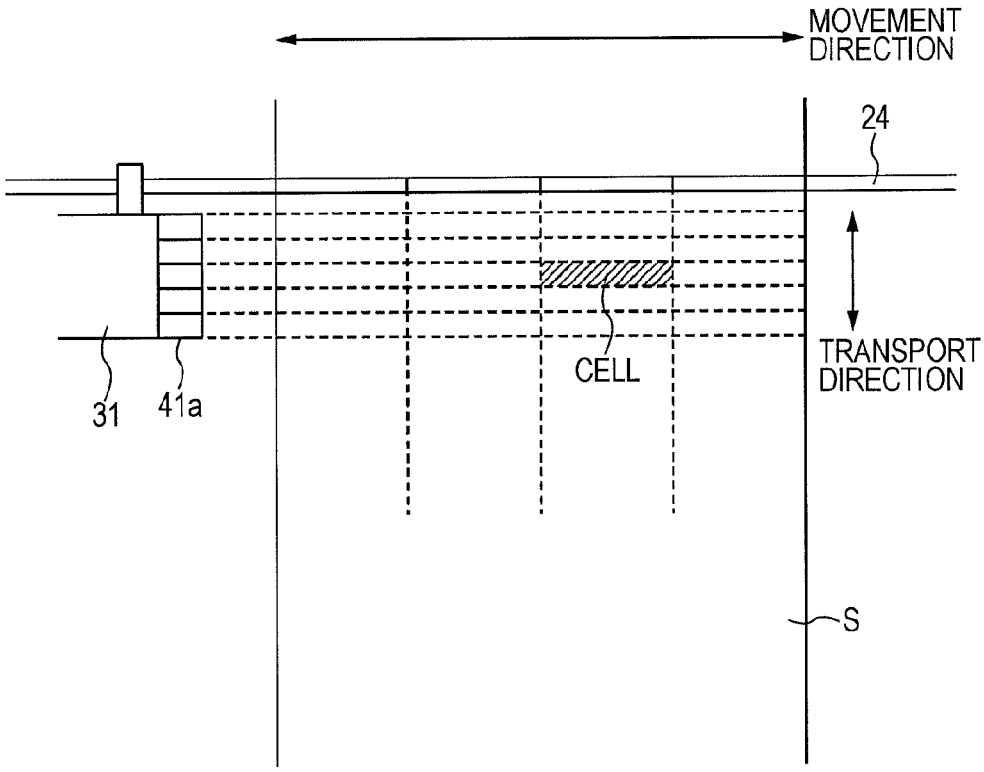
FIG. 8 is a diagram conceptually illustrating cells obtained by dividing the print surface of paper into a grid shape.

Ink discharge amounts are then found for each of the colors per unit of area (for example, per square inch) in respective movement sections and respective irradiation regions to be irradiated by the irradiation units 42 per pass (S708). In other words, by dividing the print surface of the paper S into respective irradiation regions in the transport direction and into respective movement sections in the movement direction, cells obtained by dividing the print surface into a grid shape are virtually defined, and the ink discharge amounts for each of the colors per unit of area are found for each cell in a pass. FIG. 8 is a diagram conceptually illustrating cells obtained by dividing the print surface of the paper S into a grid shape. As shown in FIG. 8, a printing region where printing is carried out on the paper S is divided in the transport direction based on the irradiation units 42 and in the movement direction based on the movement sections, thus dividing the printing region into cells in a grid shape. Based on the rasterized print data, the ink discharge amounts for each of the colors per unit of area are found for each cell obtained by dividing the printing region into a grid shape, on a pass-by-pass basis.

Next, the ink discharge amounts for each of the colors per unit of area for each cell, weighted depending on the ease of curing of each of the multiple colors, are found based on the calculated ink discharge amounts for each of the colors per unit of area and the ease of curing of the multiple colors with respect to ultraviolet light (S709).

To be more specific, taking the ink droplet amount of a large dot as α(ng), the ink droplet amount of a medium dot as β(ng), and the ink droplet amount of a small dot as γ(ng), and taking a cyan ink ease of curing coefficient as c, a magenta ink ease of curing coefficient as m, a yellow ink ease of curing coefficient as y, and a black ink ease of curing coefficient as k, an ink discharge amount V(ng) for each of the multiple colors per unit of area in each cell that has been weighted based on the ease of curing of each of the multiple colors can be found through, for example, the following Equation (1).

$$V=c(\alpha\cdot A_c+\beta\cdot B_c+\gamma\cdot C_c)+m(\alpha\cdot A_m+\beta\cdot B_m+\gamma\cdot C_m)+y(\alpha\cdot A_y+\beta\cdot B_y+\gamma\cdot C_y)+k(\alpha\cdot A_k+\beta\cdot B_k+\gamma\cdot C_k) \quad (1)$$

Here, $A_c$ is the number of large dots of cyan ink per unit of area, $A_m$ is the number of large dots of magenta ink per unit of area, $A_y$ is the number of large dots of yellow ink per unit of area, and $A_k$ is the number of large dots of black ink per unit of area. Likewise, $B_c$, $B_m$, $B_y$, and $B_k$ are the numbers of medium dots of the respective colors per unit of area, whereas $C_c$, $C_m$, $C_y$, and $C_k$ are the numbers of small dots of the respective colors per unit of area.

Meanwhile, the ease of curing coefficients c, m, y, and k of the respective colors of ink with respect to ultraviolet light increase in value in the case where the ink is cured under even a small amount of ultraviolet light irradiation, whereas the same coefficients decrease in value in the case where the ink cannot be cured without a large amount of ultraviolet light irradiation.

Note that an ink discharge amount V' per unit of area that is not weighted based on the ease of curing is controlled so as to be a maximum ink discharge amount $V_{max}$ at its maximum. In other words, in the case of so-called solid printing, the ink discharge amount per unit of area is the maximum ink discharge amount $V_{max}$.

Here, the ink discharge amount V' per unit of area that is not weighted based on the ease of curing is expressed by the following Equation (2).

$$V'=\alpha(A_c+A_m+A_y+A_k)+\beta(B_c+B_m+B_y+B_k)+\gamma(C_c+C_m+C_y+C_k) \quad (2)$$

The ink discharge amount for each of the multiple colors per unit of area in each cell that has been weighted based on the ease of curing of each of the multiple colors is then found based on the calculated ink discharge amounts for each of the multiple colors per unit of area of each cell. Furthermore, irradiation conditions for each cell are determined on a pass-by-pass basis based on the ink discharge amount for each of the multiple colors per unit of area in each cell that has been weighted based on the ease of curing of each of the colors (S710).

Here, "irradiation conditions" refer to the irradiation energy amount (mJ/cm$^2$) per unit of area of the ultraviolet light irradiated by the irradiation units 42. This is found by taking the product of the irradiation strength (mW/cm$^2$) of the provisional curing units 41*a* and 41*b* and the irradiation time (s) on each dot. Meanwhile, the irradiation time(s) on each dot is found by dividing the length (cm) in the movement direction of the region of the paper S that is irradiated by the ultraviolet light by the movement speed (cm/s) of the provisional curing units 41*a* and 41*b*.

Note that the lengths of the movement sections are greater than a length found by taking the product of the movement speed (cm/s) of the provisional curing units 41*a* and 41*b* and the time(s) required for the provisional curing units 41*a* and 41*b* to switch the irradiation conditions.

Figure 9:
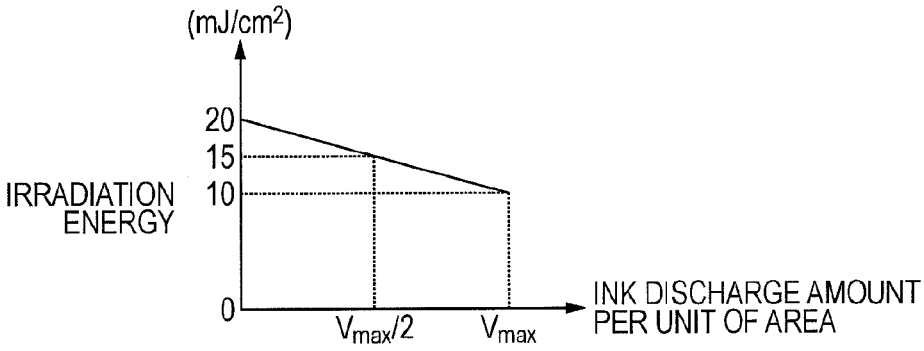
FIG. 9 is a graph illustrating a relationship between an ink discharge amount per unit of area and an irradiation strength of ultraviolet light.

FIG. 9 is a graph illustrating a relationship between the ink discharge amount per unit of area and the irradiation strength of ultraviolet light. In FIG. 9, the control unit 60 controls the provisional curing units 41*a* and 41*b* to increase the irradiation energy amount per unit of area of the ultraviolet light as the ink discharge amount per unit of area decreases.

The print data that has undergone the rasterizing process and the irradiation conditions are sent to the printer 2 (S711). Then, the printer 2 prints an image onto the paper S based on the received print data and irradiation conditions (S712).

Usefulness of the Embodiment

According to this embodiment, a drop in image quality can be suppressed by determining the irradiation conditions of the provisional curing units 41*a* and 41*b* based on the ink discharge amounts of each of the multiple colors per unit of area that have been weighted based on the ease of curing of each of the multiple colors.

Generally speaking, UV curable ink is cured by irradiating the ink with ultraviolet light and evoking a radical polymerization reaction, but when the UV curable ink comes in contact with oxygen, the oxygen acts as an inhibitor, reducing the chain polymerization speed. Accordingly, ink layers are susceptible to the effects of oxygen on their top layers in areas where the ink discharge amount per unit of area is low, leading to a tendency for oxygen inhibition to occur and difficulties in curing the ink layer. In order to address this property of UV curable ink, the control unit 60 performs control so as to increase the irradiation energy amount per unit of area the lower the ink discharge amount for each of the multiple colors per unit of area is. Furthermore, the ease of curing of the respective colors with respect to ultraviolet light is taken into consideration, and adjustments are made to reduce the irradiation energy amount for ink that cures easily and increase the irradiation energy amount for ink that does not cure easily. Accordingly, the UV curable ink that has landed on the paper S can be irradiated with an appropriate amount of ultraviolet light, thus making more optimal curing possible. Furthermore, because no more ultraviolet light than is necessary for the provisional curing is irradiated, this technique conserves energy as well.

Figures 10, 11:
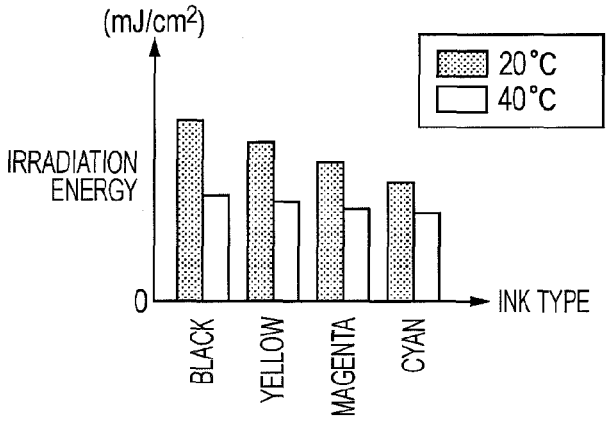
FIG. 10 is a chart illustrating relationships between irradiation strengths of an irradiation unit and image qualities.
FIG. 11 is a graph illustrating necessary ultraviolet light irradiation amounts for curing predetermined amounts of respective colors of ink at different temperatures.

FIG. 10 is a chart illustrating a relationship between the irradiation energy amount of the provisional curing units 41*a* and 41*b*, and surface tackiness and bleed. As shown in FIG. 10, in the case where the ink discharge amount per unit of area that is weighted based on the ease of curing for each of the multiple colors is low, a low irradiation energy amount leads to an unfavorable state for surface tackiness and bleed. However, if the irradiation energy amount is controlled in accordance with the ink discharge amount per unit of area, increasing the irradiation energy amount when the ink discharge amount per unit of area is low and decreasing the irradiation energy amount when the ink discharge amount per unit of area is high, a favorable state in terms of surface tackiness and bleed is achieved.

In addition, if the surface tackiness is favorable as a result of optimal curing, the ease of handling the product after printing (the printed material) improves as well. In other words, because the optimal curing is carried out on the printed image, the UV curable ink that has landed on the paper S will not adhere to other areas.

Furthermore, performing optimal curing results in a uniform glossiness across the entire image, thus improving the overall appearance of the image.

In addition, according to this embodiment, the ink discharge amounts are found for each of the colors per unit of area in respective movement sections and respective irradiation regions to be irradiated by the irradiation units 42 per pass, and irradiation conditions for each cell are determined on a pass-by-pass basis based on the calculated ink discharge amounts for each of the multiple colors per unit of area in each cell; accordingly, optimal curing can be carried out in a precise manner for each area of the paper S.

Furthermore, the lengths of the movement sections are greater than a length found by taking the product of the movement speed (cm/s) of the provisional curing units 41*a* and 41*b* and the time(s) required for the provisional curing units 41*a* and 41*b* to switch the irradiation conditions, and thus the switching of the irradiation conditions of the provisional curing units 41*a* and 41*b* can follow the movement speed, making it possible to execute the provisional curing process in a more accurate manner. This makes it possible to further suppress a drop in the image quality.

Other Embodiments

Although the first embodiment primarily discusses a printing apparatus, the embodiment also includes the disclosure of a printing method and so on. Furthermore, the first embodiment is provided to facilitate understanding of the invention and is not to be interpreted as limiting the invention in any way. It goes without saying that many variations and modifications can be made without departing from the essential spirit of the invention, and thus all such variations and modifications also fall within the scope of the invention. In particular, the embodiments described hereinafter also fall within the scope of the invention.

Movement Mechanism

Although the first embodiment describes the paper S as being moved relative to the head by transporting the paper S, while the head being moved by the carriage unit 20, the movement mechanism is not limited thereto. For example, the head may be moved relative to the paper S by moving the head 31, the provisional curing units 41*a* and 41*b*, and the final curing unit 43 with the paper S located at a predetermined position.

Head

The first embodiment employs the head 31, which discharges ink using piezoelectric elements. However, the system for discharging the liquid is not limited thereto. For example, another system, such as a system that causes bubbles to form within the nozzles using heat, may be employed.

UV Curable Ink, Provisional Curing Unit, and Final Curing Unit

Although the first embodiment describes UV curable ink as an example of the ink discharged from the head 31 and ultraviolet light as the electromagnetic waves irradiated by the provisional curing units 41*a* and 41*b* and the final curing unit 43, the invention is not limited thereto. For example, electromagnetic waves such as electron beams, X-rays, visible light rays, or the like may be included in the electromagnetic waves irradiated by the provisional curing units 41*a* and 41*b*. The final curing unit 43, too, may irradiate electromagnetic waves such as electron beams, X-rays, visible light rays, or the like. Furthermore, the ink may be an ink that is cured by electromagnetic waves corresponding to those mentioned here.

Changes in Ease of Curing of Ink Due to Ambient Temperature

Although the first embodiment describes the ease of curing of the ink with respect to ultraviolet light as constant, changes in the ease of curing of the ink with respect to the ultraviolet light due to the ambient temperature may be taken into consideration.

FIG. 11 is a graph illustrating necessary ultraviolet light irradiation amounts for curing predetermined amounts of respective colors of ink at different temperatures (20° C. and 40° C.). As shown in FIG. 1, each ink can be cured using a lesser amount of ultraviolet light irradiation when the ambient temperature is high than when the ambient temperature is low. In other words, when the ambient temperature is high, the ink is more reactive to the ultraviolet light. Meanwhile, FIG. 12 is a diagram illustrating the data structure of a database indicating correspondence relationships between ambient temperatures and ease of curing of respective colors as stored in the computer 3 in advance.

The printer 2 includes a temperature sensor (not shown) that detects the ambient temperature, and the computer finds the ease of curing for each of the colors based on the ambient temperatures detected by the temperature sensor and the database indicating the correspondence relationships between the ambient temperatures and the ease of curing of respective colors as stored in the computer 3 in advance. Using the ease of curing for each of the colors, the ink discharge amount for each of the multiple colors per unit of area that has been weighted based on the ease of curing for each of the colors is found.

According to such an embodiment, the irradiation conditions of the provisional curing units 41*a* and 41*b* can be determined accurately in accordance with the ambient temperature, making it possible to further suppress a drop in image quality.

Control Flow of Provisional Curing Units 41*a* and 41*b*

In the first embodiment, the ink discharge amounts are found for each of the colors per unit of area in respective movement sections and respective irradiation regions to be irradiated by the irradiation units 42 per pass, and irradiation conditions for each cell are determined on a pass-by-pass basis based on the ink discharge amounts for each of the multiple colors per unit of area in each cell weighted based on the ease of curing of each color.

However, rather than determining the irradiation conditions at the cell level, the irradiation conditions may simply be determined at the pass level. According to such an embodiment, the amount of information processed by the computer 3 can be reduced.

Furthermore, the ink discharge amount for each of the multiple colors per unit of area in each movement section may be found on a pass-by-pass basis, and the irradiation conditions for each movement section may be determined on a pass-by-pass basis based on the ink discharge amounts for the each of the multiple colors per unit of area in each movement section that are weighted based on the ease of curing of each color.

In addition, the ink discharge amounts for each of the multiple colors per unit of area in each irradiation region irradiated by the irradiation units 42 may be found on a pass-by-pass basis, and the irradiation conditions for each irradiation region may be determined on a pass-by-pass basis based on the ink discharge amounts for each of the multiple colors per unit of area in each of the irradiation regions that have been weighted based on the ease of curing of each color.

Controller

Although the first embodiment describes the controller that executes the processes indicated in S701 to S710 of FIG. 7 as being provided in the computer 3, the controller may instead be provided in the printer 2, and in such a case, the controller provided in the printer 2 may execute the processes indicated in S701 to S710.

Furthermore, a controller may be provided in both the printer 2 and the computer 3, and in such a case, the controllers provided in the printer 2 and the computer 3 may distribute the processes indicated in S701 to S710 between themselves and execute those processes.

Printing Process Flow

In the printing process flow illustrated in FIG. 7, the process indicated in S711 may be executed before the processes indicated in S701 to S710.

The entire disclosure of Japanese Patent Application No. 2009-272433, filed Nov. 30, 2009 is expressly incorporated by reference herein.

What is claimed is:

1. A printing system comprising:

a head that discharges electromagnetically-curable ink of multiple colors, each color having a different ease of curing with respect to electromagnetic wave, onto a medium;

a provisional curing unit, common for all of the colors, that provisionally cures the electromagnetically-curable ink that has landed on the medium by irradiating the electromagnetically-curable ink with electromagnetic waves; and a controller that determines an irradiation condition of the provisional curing unit based on an ink discharge amount for each of the multiple colors per unit of area that has been found based on print data that has undergone a halftone process for each of the multiple colors, the ink discharge amount being weighted based on the ease of curing of each of the colors.

2. The printing system according to claim 1, further comprising:

a temperature sensor that detects an ambient temperature, wherein the head discharges, onto the medium, electromagnetically-curable ink of multiple colors whose ease of curing changes depending on the ambient temperature; and the controller finds the ease of curing of each color based on the ambient temperature, and determines the irradiation condition of the provisional curing unit based on the ink discharge amounts for each of the multiple colors per unit of area that have been weighted based on the ease of curing of each color.

3. The printing system according to claim 1, further comprising:

a computer and a printing apparatus capable of communicating with the computer, wherein the computer includes: the controller; and an interface that sends print data that has undergone a halftone process for each of the multiple colors and the irradiation condition of the provisional curing unit to the printing apparatus, and the printing apparatus includes:

the head;

the provisional curing unit; and an interface that receives the print data that has undergone a halftone process for each of the multiple colors and the irradiation condition from the computer.

4. The printing system according to claim 1, further comprising:

a computer and a printing apparatus capable of communicating with the computer, wherein the computer includes:

an interface that sends print data that has undergone a halftone process for each of the multiple colors to the printing apparatus, and the printing apparatus includes: the head; the provisional curing unit; the controller; and an interface that receives the print data that has undergone a halftone process for each of the multiple colors from the computer.

5. A printing control program stored on a non-transitory computer readable medium for controlling a printing apparatus including a head that discharges electromagnetically-curable ink of multiple colors, each color having a different ease of curing with respect to electromagnetic wave, onto a medium, and a provisional curing unit, common for all of the colors, that provisionally cures the electromagnetically-curable ink that has landed on the medium by irradiating the electromagnetically-curable ink with electromagnetic waves, the program causing a computer to:

generate print data that has undergone a halftone process for each of the multiple colors;

find an ink discharge amount for each of the multiple colors per unit of area based on the print data that has undergone the halftone process; and determine an irradiation condition of the provisional curing unit based on the ink discharge amounts for each of the multiple colors per unit of area that have been weighted based on the ease of curing of each color.

6. A printing method by which a printing apparatus performs printing, the method comprising:

generating print data that has undergone a halftone process for each of multiple colors;

finding an ink discharge amount for each of the multiple colors per unit of area based on the print data that has undergone the halftone process;

determining an irradiation condition of a provisional curing unit that provisionally cures electromagnetically-curable ink by irradiating the ink with electromagnetic waves based on the ink discharge amounts for each of the multiple colors per unit of area that have been weighted based on an ease of curing of each color;

discharging the electromagnetically-curable ink of multiple colors, each color having a different ease of curing with respect to electromagnetic wave, from a head onto a medium; and provisionally curing the electromagnetically-curable ink that has landed on the medium by irradiating the electromagnetically-curable ink with electromagnetic waves from the provisional curing unit based on the irradiation condition.

* * * * *